United States Patent [19]

Tubbs

[11] Patent Number: 4,740,172

[45] **Date of Patent: * Apr. 26, 1988**

[54] MODULAR ADAPTER AND CONNECTOR CABLE FOR VIDEO EQUIPMENT

[75] Inventor: Joseph T. Tubbs, Lynchburg, Va.

[73] Assignee: Trans World Connections Ltd., Lynchburg, Va.

[ * ] Notice: The portion of the term of this patent subsequent to Mar. 10, 2004 has been disclaimed.

[21] Appl. No.: 940,025

[22] Filed: Dec. 8, 1986

Related U.S. Application Data

[63] Continuation-in-part of Ser. No. 743,707, Jun. 11, 1985, Pat. No. 4,648,682.

[51] Int. Cl.[4] ..... H01R 13/625

[52] U.S. Cl. ..... 439/344; 439/641; 439/653

[58] Field of Search ..... 339/153–157, 339/176 R, 176 M, 177, 159, 164–166, 169; 439/344

[56] References Cited

U.S. PATENT DOCUMENTS

| | | | |
|---|---|---|---|
| 4,220,391 | 9/1980 | Krolak et al. | 339/176 M |
| 4,268,109 | 5/1981 | Hardesty | 339/156 R |
| 4,447,106 | 5/1984 | Houtz et al. | 339/176 M |
| 4,472,010 | 9/1984 | Parnello | 339/176 M |
| 4,477,141 | 10/1984 | Hardesty | 339/176 M |
| 4,477,144 | 10/1984 | Huang | 339/177 R |

OTHER PUBLICATIONS

REA Bulletin 345-81, PE-76, "Specifications for Modular Telephone Set Hardware" (Aug. 1978).

A. Meier, "The Modular Telephone—A Money Saving Idea Whose Time has Come", *Telephony* 27-33 (Nov. 25, 1974).

*Primary Examiner*—Gil Weidenfeld

*Assistant Examiner*—David Pirlot

*Attorney, Agent, or Firm*—Mason, Fenwick & Lawrence

[57] ABSTRACT

Modular apparatus for connecting the output terminals of one article of video equipment to the input terminals of a second article of video equipment, comprising first and second modular adapters and at least one modular connector cable. Each modular adapter comprises an insulated housing comprising a modular jack portion and either a coaxial connector portion or a twin-lead cable portion. A standard, six-position modular telephone jack is positioned in the modular jack portion. A male coaxial connector is positioned in the coaxial connector portion, while a 300 ohm twin-lead cable is positioned in the twin-lead cable portion. In one embodiment, the conductors of the modular jack are electrically connected to the solid central conductor and the conductive wire sheath of the coaxial connector, or to the wires of the twin-lead cable. In a second embodiment, at least one of the modular adapters further comprises a screw terminal portion having first and second 300 ohm screw terminals positioned therein and a switch portion having a two position switch positioned therein. The switch permits selective connection of the coaxial connector or the twin-lead cable to either the modular jack or the screw terminals.

18 Claims, 5 Drawing Sheets

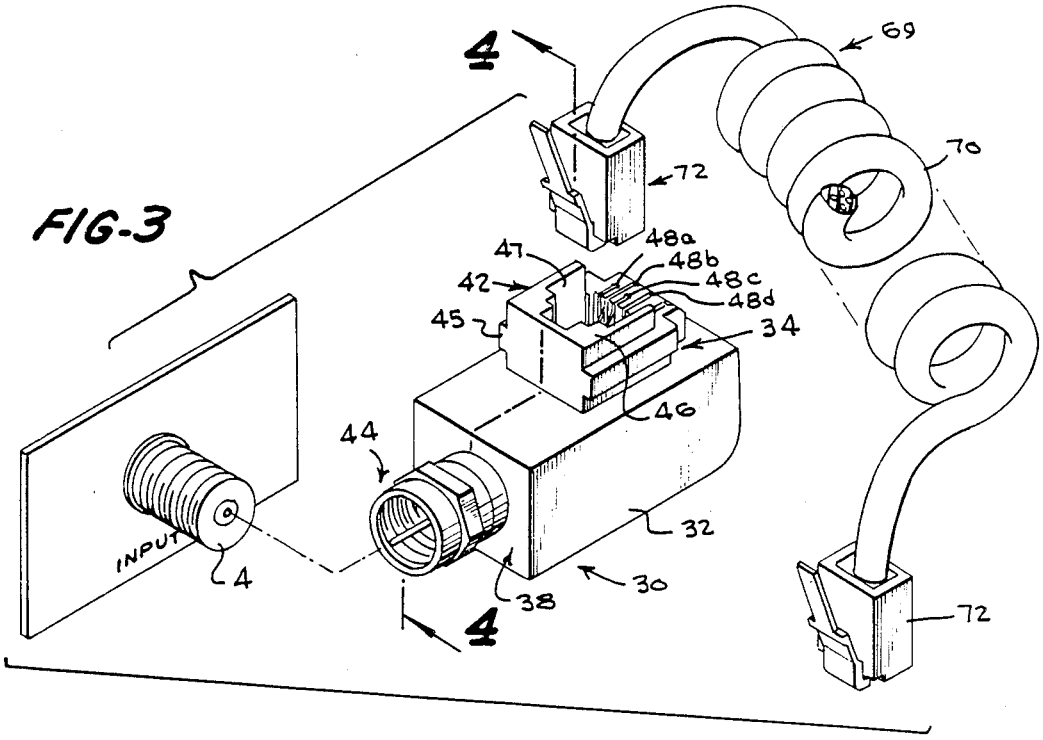
FIG-3
4
69
70
72
47
48a
48b
48c
48d
42
45
34
46
44
32
INPUT
4
38
30
4
72
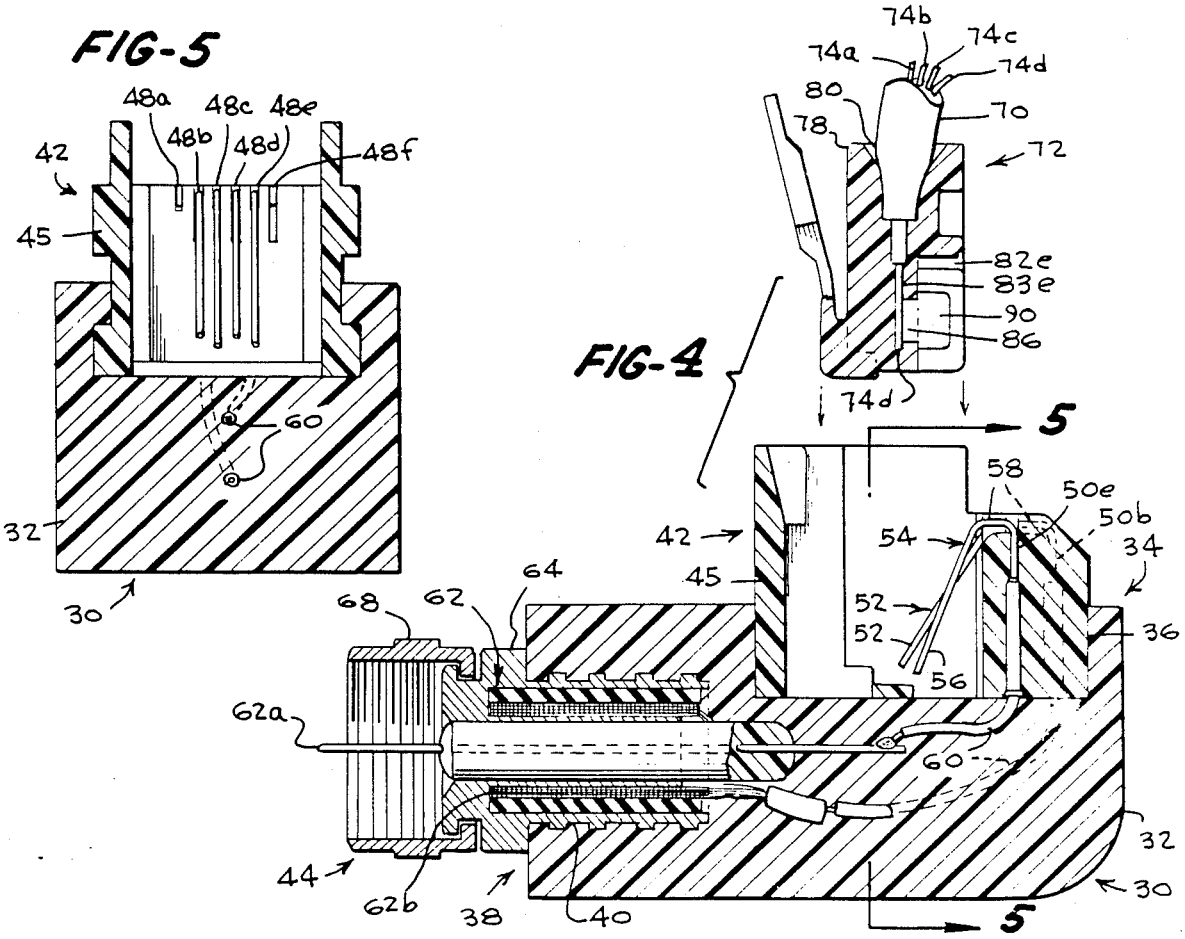
FIG-5
48a
48c
48e
48b
48d
48f
42
45
60
32
30
FIG-4
74b
74c
74a
74d
80
70
78
72
82e
83e
90
86
74d
5
58
50e
50b
42
54
34
45
64
52
52
36
68
62
56
62a
60
32
44
62b
38
40
30
5

FIG-6
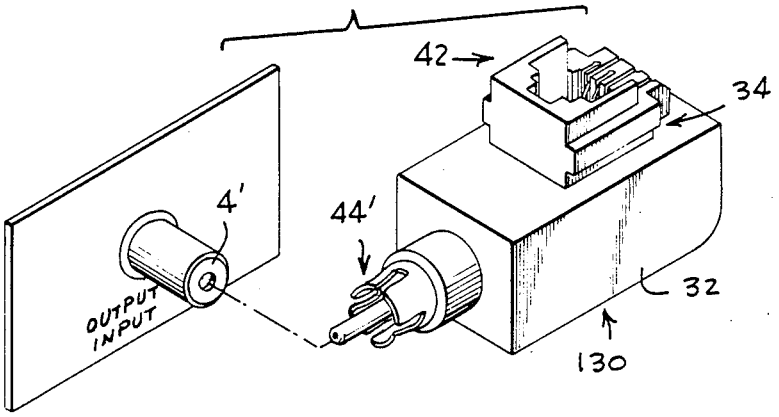
FIG-7
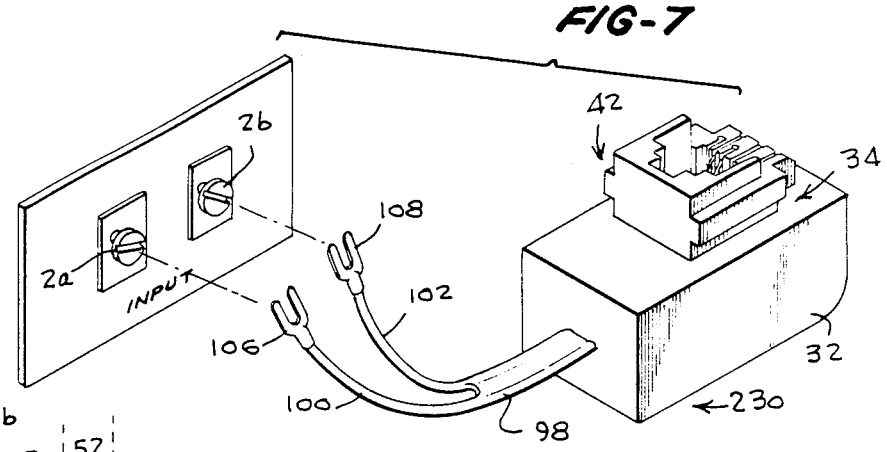
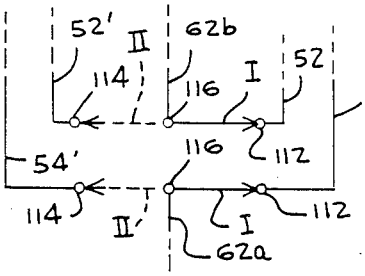
FIG-10
FIG-8
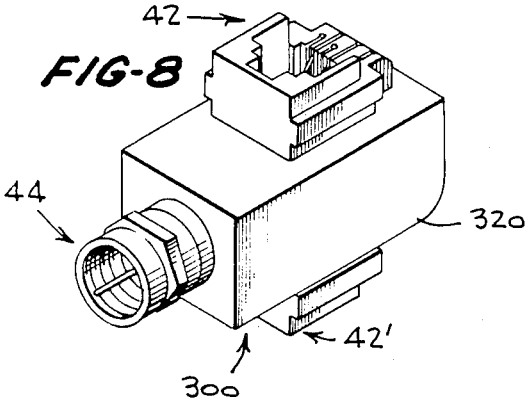
FIG-9
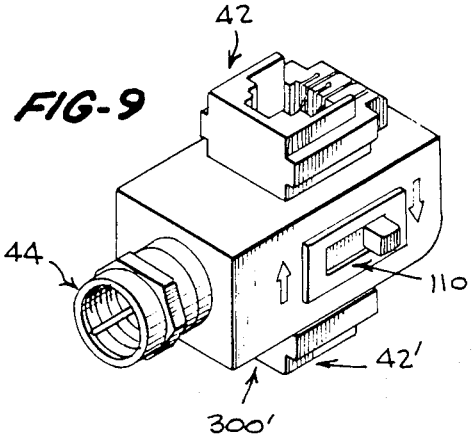

MODULAR ADAPTER AND CONNECTOR CABLE FOR VIDEO EQUIPMENT

BACKGROUND OF THE INVENTION

This application is a continuation in-part of my Ser. No. 743,707 filed June 11, 1985, now U.S. Pat. No. 4,648,682.

The present invention is directed to the field of adapters, and is more specifically directed to modular adapters for use in combination with a modular connector cable in connecting a video cassette recorder (VCR) to a television, a computer monitor, or other video equipment, or in connecting a television antenna, a television, or a computer monitor to other video equipment.

As shown in FIGS. 1*a*, 1*b*, and 1*c*, a television 200 generally is provided with a pair of 300 ohm antenna screw terminals 6*a* and 6*b* for receiving VHF input. There are three basic kinds of hook-ups between a television and an antenna, which depend upon the kind of antenna used, as shown in FIGS. 1*a*, 1*b*, and 1*c*. In the first kind, shown in FIG. 1*a*, an outside VHF antenna (not shown) is connected to the 75 ohm terminal 4 of the television with a 75 ohm (round) coaxial cable 8 and an outside UHF antenna (not shown) is connected to the 300 ohm UHF terminals 2*a* and 2*b* of the television with a 300 ohm (flat) twin-lead cable 10. In the second kind, shown in FIG. 1*b*, an outside VHF antenna or an inside VHF antenna (not shown) is connected to the 300 ohm VHF terminals 6*a* and 6*b* of the television with a 300 OHM (flat) twin-lead cable 12 and an outside UHF antenna is again connected to the 300 ohm UHF terminals 2*a* and 2*b* of the television with a 300 ohm (flat) twin-lead cable 10. In the third kind, shown in FIG. 1*c*, an outside UHF/VHF antenna (not shown) is connected to a signal splitter 14 connected to twin lead cables 15*a* and 15*b* to provide UHF and VHF inputs from a 75 ohm (round) cable 16 to the 300 ohm terminals 2*a* and 2*b* and 6*a* and 6*b*, respectively.

Referring now to FIGS. 2*a*–2*c*, when a VCR 250 is used in conjunction with the television 200, the UHF and VHF antenna input must be fed to the television 200 through the VCR 250. For this purpose VCR's are provided with 75 ohm VHF female RF coaxial input and output terminals 18*a* and 18*b*, 300 ohm UFH input screw terminals 20*a* and 20*b* and output screw terminals 22*a* and 22*b*, and a 300 ohm to 75 ohm VHF antenna adapter 24 (shown in FIGS. 2*b* and 2*c*).

At present, as shown in FIGS. 2*a*–2*c*, a 75 ohm RG 59 (round) coaxial connector cable 26 terminated at its ends by two male RF coaxial connectors 26*a* and 26*b* of the F-connector type is used between the VHF antenna terminal 4 or the 300 ohm VHF terminals 6*a* and 6*b* of the television, while a 300 ohm (flat) twin-lead connector cable 27 is used between the UHF output terminals 22*a* and 22*b* of the VCR and the UHF antennas 2*a* and 2*b* of the television. In addition, when the VHF antenna uses a 300 ohm twin-lead cable 12, as shown in FIG. 2*b*, or a signal splitter 14, as shown in FIG. 2*c*, a 75 ohm to 300 ohm VHF matching transformer 29 having a twin-lead connector 29*a* must be used between the RG 59 connector cable 26 and the VHF terminals 6*a* and 6*b* of the television.

The RG 59 connector cable is an expensive and very bulky means of connecting the VCR to the television. It also creates a nest of wires behind the VCR and the television, which at best is unattractive, and at worst poses a safety hazard.

There are also situations when it may be desirable to hook up a VCR to other video equipment, for example a computer monitor or a video amplifier. Such hook-ups require additional cables and connectors not generally provided by VCR manufacturers with the purchase of a VCR. Such cables and connectors as are available to the consumer in the electronic after-market are as expensive and bulky as the connector cables provided with the VCR, and only add to the nest of wires already running between the VCR and the television.

Also, there may be situations when it would be desirable to view VCR or antenna output on a television or monitor other than the one to which the VCR or antenna is directly connected. Presently, in order to accomplish this, it is necessary to feed the VCR or antenna output signal into a multiple output signal splitter, either alone or in combination with a video amplifier, and run connector cables from the signal splitter to those televisions where the output is desired to be seen. If the second television or monitor is in another room this may require running connector cables between several rooms, which is both expensive and a safety hazard. Also, it becomes very impractical to connect a VCR or antenna and a television which are on different floors.

There may be further situations when it would be desirable to be able to switch between inputs to an article of video equipment, for example between antenna or VCR input to a television, or to switch between outputs from an article of video equipment, for example between one of two televisions connected to a VCR. Some cables and connectors for such purposes are available to the consumer in the electronic after-market, while others must be improvised, but all tend to be expensive, bulky, and awkward to install and disconnect, and result in a nest of wires behind the video equipment. It is the solution of these and other problems to which the present invention is directed.

SUMMARY OF THE INVENTION

Therefore, it is a primary object of this invention to provide a modular adapter for use in combination with a modular connector cable which can replace the original equipment connector cable between a VCR and a television.

It is another object of this invention to provide a modular adapter for use in combination with a modular connector cable which can connect a VCR to a computer monitor.

It is another object of this invention to provide a modular adapter for use in combination with a modular connector cable which can connect a VCR to a video amplifier.

It is still another object of this invention to provide a modular adapter for use in connection with a modular connector cable which can connect a VCR to a television in another room using the building telephone wiring.

It is still another object of this invention to provide a modular adapter for use in combination with a modular connector cable which can easily connect and disconnect a VCR to and from other video equipment.

It is another object of this invention to provide a modular adapter for use in combination with a modular connector cable which can easily connect and disconnect a television antenna, a television, or a monitor to and from other video equipment.

It is another object of this invention to provide a modular adapter for use in combination with a modular connector cable which can be used to switch between different inputs to or from different articles of video equipment.

These and other objects of this invention are achieved by the provision of a modular adapter comprising an insulated housing and a standard, six-position modular telephone jack and a male coaxial connector positioned in the housing. The modular telephone jack has at least two conductors mounted therein in two of the six positions. Two of these conductors are electrically connected to the solid center conductor and the conductive tubular wire shield of the male RF coaxial connector.

A modular connector cable is provided comprising an insulated cable having at least two insulated wires therein terminated at either end by a standard six-position modular telephone plug. Each modular plug has first and second conductive terminals contained therein piercing first and second wires, respectively, of the cable. The conductive terminals are positioned in two of the six positions of the modular plug corresponding to the positions in which the first and second conductors are mounted in the modular telephone jack. In one aspect of the invention, the conductors of the modular jack and the conductive terminals of the modular plugs are positioned in positions two and five of the modular jack and the modular plugs, so that the modular plugs can be plugged into the modular jacks of a building's telephone wiring without interfering with the telephone system.

In another aspect of the invention, the modular adapter comprises a housing and a standard six-position modular telephone jack and a 300 ohm twin-lead cable positioned therein.

In a third aspect of the invention, the modular adapter comprises a housing, and two standard six-position modular telephone jacks and a male RF coaxial connector positioned in the housing. A two pole slide switch can also be positioned in the housing to select between the jacks.

In a fourth aspect of the invention, the modular adapter comprises a housing and a standard six-position modular telephone jack, a male RF coaxial connector, a pair of 300 ohm screw terminals, and a two pole slide switch positioned therein. The slide switch permits selection between the modular jack and the 300 ohm screw terminals.

In a fifth aspect of the invention, the modular adapter comprises a housing and a standard six-position modular telephone jack, a 300 ohm twin lead cable, a pair of 300 ohm screw terminals, and a two pole slide switch positioned therein. The slide switch permits selection between the modular jack and the 300 ohm screw terminals.

In a sixth aspect of the invention, the modular adapter comprises a housing and three standard six-position modular telephone jacks and a two pole slide switch positioned therein.

The slide switch permits selection between two of the modular jacks.

In a seventh aspect of the invention, the modular adapter comprises a housing and a two standard six-position modular telephone jacks, a pair of 300 ohm screw terminals, and a two pole slide switch positioned therein. The slide switch permits selection between the 300 ohm screw terminals and one of the modular jacks and the other modular jack.

A better understanding of the disclosed embodiments of the invention will be achieved when the accompanying detailed description is considered in conjunction with the appended drawings, in which like reference numerals are used for the same parts as illustrated in the different figures.

BRIEF DESCRIPTION OF THE DRAWINGS

FIG. 3 is an exploded perspective view of a VHF adapter and connector cable according to the invention in use with a 75 ohm VHF input terminal;

FIG. 4 is a cross-sectional view of the adapter and connector cable of FIG. 3, taken along line 4—4 of FIG. 3;

FIG. 5 is a cross-sectional view of the adapter of FIG. 3, taken along line 5—5 of FIG. 4;

FIG. 6 is an exploded perspective view of another embodiment of a VHF adapter according to the invention, in use with a phono input/output terminal;

FIG. 7 is an exploded perspective view of a UHF adapter according to the invention in use with a 300 ohm UHF terminal;

FIG. 8 is a perspective view of a third embodiment of a VHF adapter;

FIG. 9 is a perspective view of a fourth embodiment of a VHF adapter;

FIG. 10 is a partial circuit diagram of the VHF adapter of FIG. 9;

DESCRIPTION OF THE PREFERRED EMBODIMENTS

Figure 1A:
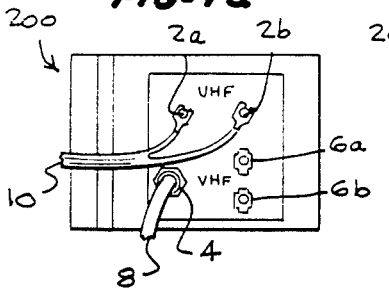
FIG. 1*a* is a partial, rear elevational view of a first hook-up between a television and UHF and VHF antennas.
Figure 1B:
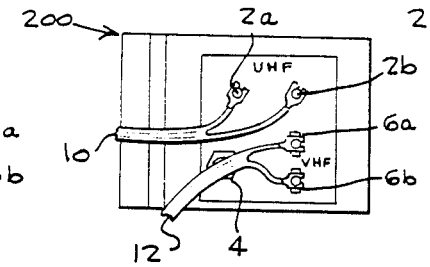
FIG. 1*b* is a partial, rear elevational view of a second hook-up between a television and UHF and VHF antennas.
Figure 1C:
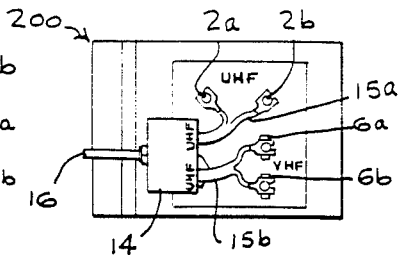
FIG. 1*c* is a partial, rear elevational view of a third hook-up between a television and a UHF/VHF antenna.

Referring now to FIGS. 3–5, there is shown a preferred embodiment of the invention, in which the reference numeral 30 refers to a VHF modular adapter. VHF adapter 30 comprises a moulded, insulated housing 32 having a modular jack portion 34, modular jack-receiving opening 36 extending into modular jack portion 34, a coaxial connector portion 38, and a coaxial connector-receiving opening 40 extending into coaxial connector portion 38. A standard, six-position modular telephone connector or jack 42 of the kind described in 41 Fed. Reg. 28694-28707 (July 12, 1976) is positioned in modular jack-receiving opening 36. An RF coaxial connector 44 of the F-connector type is positioned in coaxial connector-receiving opening 40. Preferably, housing 32 is made from PVC, and is moulded around modular jack 42 and RF coaxial connector 44.

Modular jack 42 comprises an insulated housing 45 having a plug-receiving portion 46, and a modular plug-receiving opening 47 extending into plug-receiving portion 46. First, second, third, fourth, fifth, and sixth spaced-apart recesses 48*a*, 48*b*, 48*c*, 48*d*, 48*e*, and 48*f* are provided in plug-receiving opening 47, which communicate with first through sixth channels (only second and fifth channels 50*b* and 50*e* are shown), respectively. Positions 1–6 of modular jack 42 correspond to the locations of recesses 48*a*–48*f*, respectively, and the first through sixth channels, respectively. The first through sixth channels extend through jack housing 45 and communicate with modular jack-receiving opening 36.

First and second stamped and formed conductors 52 and 54 are mounted in jack housing 45 in parallel, spaced-apart relation in positions 2 and 5. Each conductor has a contact spring portion 56 which extends diagonally from plug receiving portion 46 into plug-receiving opening 47, an intermediate portion 58 reversibly bent at recesses 48*b* and 48*e* in plug-receiving portion 47 extending through channels 50*b* and 50*e*, respectively, and an insulated end portion 60 extending out of channels 50*b* and 50*e* into adapter housing 32. In a preferred embodiment of the invention, a Hirose model number TNIR-623K66SE-150 modular jack is used. It should be understood that although only two conductors 52 and 54 are shown, jack 42 can include up to six conductors. However, as only two conductors are needed, it is more economical to use only two.

Figure 2A:
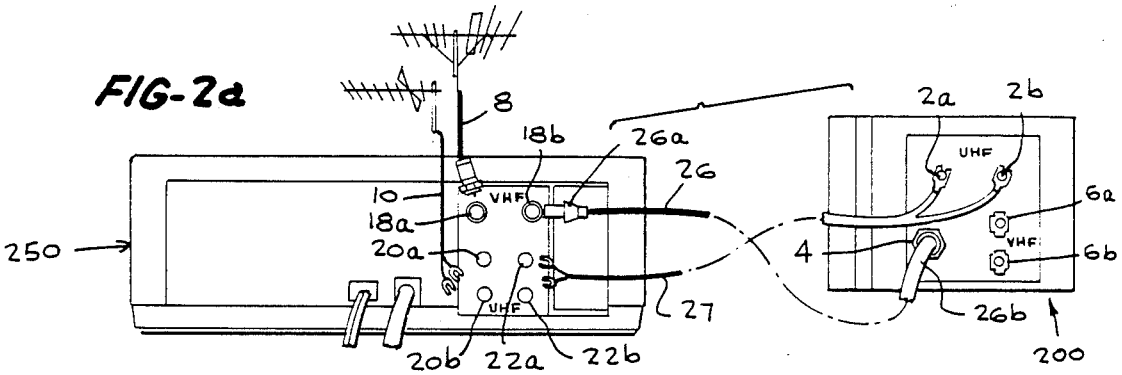
FIG. 2*a* is a rear elevational view of a first hook-up between UHF and VHF antennas, a VCR, and a television.
Figure 2B:
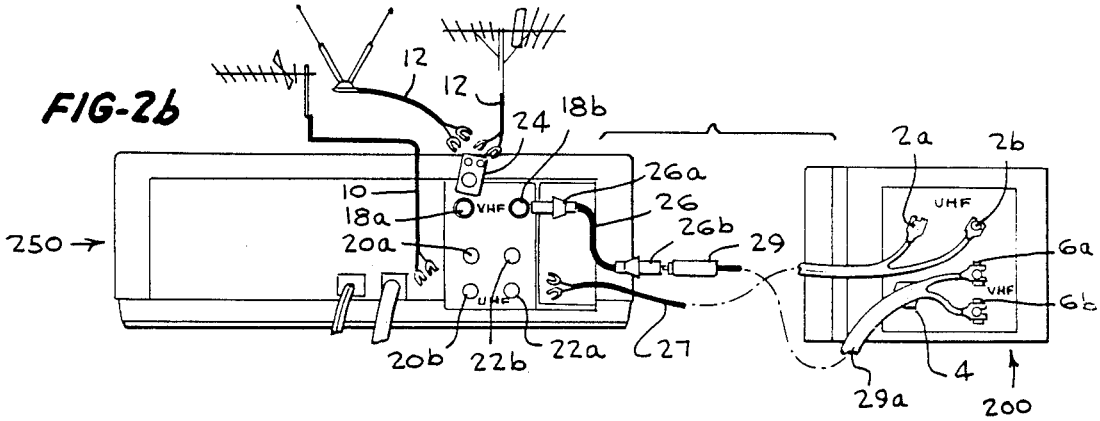
FIG. 2*b* is a rear elevational view of a second hook-up between UHF and VHF antennas, a VCR, and a television.
Figure 2C:
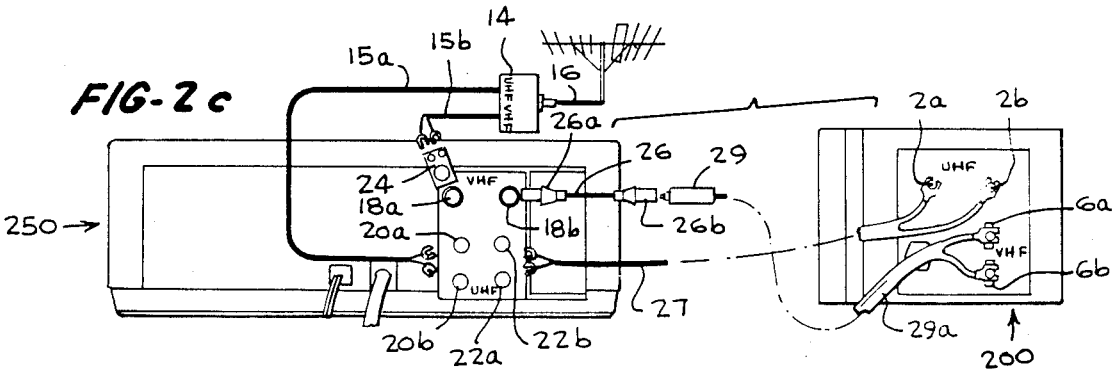
FIG. 2*c* is a rear elevational view of a third hook-up between a UHF/VHF antenna, a VCR, and a television.

RF coaxial connector 44 is similar to the RF coaxial connectors 26*a* and 26*b* (FIGS. 2*a*–2*c*) used to terminate an RG 59 coaxial cable for mating with the 75 ohm antenna terminal for a television or the VHF input and output terminals 18*a* and 18*b* of a VCR. RF coaxial connector 44 comprises a length of RG 59 coaxial cable 62 positioned in a metal housing 64, a portion of the solid central conductor 62*a* of the coaxial cable 62 extending outside the housing 64. A rotatable, internally threaded nut 68 is attached to housing 64 around central conductor 62*a* for securing connector 44 to terminals 4 or 18*b*. Alternatively, a snap collar (not shown) can be used in place of threaded nut 68 to secure F-connector 44 to terminals 4 or 18*b*. Central conductor 62*a* and conductive wire sheath 62*b* of coaxial cable 62 are electrically connected, for example by soldering, to the end portions 60 of conductors 52 and 54, respectively, of modular jack 42.

A modular adapter 30 as shown in FIG. 3 is used in pairs. One adapter 30 is coupled directly to the 75 ohm VHF antenna terminal 4 of the television, or if necessary, can be coupled to a 300 ohm to 75 ohm adapter box (matching transformer) (not shown) of the television. The other adapter 30 is connected directly to the 75 ohm VHF output terminal (not shown) of the VCR.

The two adapters 30 are electrically connected to each other by a connector cable 69 comprising an insulated cable 70 terminated at both ends by a standard, six-position modular telephone plug 72 of the kind described in 41 Fed. Reg. 28694-28707 (July 12, 1976). Insulated cable 70 has four parallel, spaced-apart insulated wires 74*a*–74*d* therein. Wires 74*a* and 74*d* are on the outside, and wires 74*b* and 74*c* are in the middle. Preferably, cable 70 is coiled, to provide maximum length in minimum space. However, standard four-wire flat telephone cable or the like can also be used.

Referring now to FIGS. 4 and 5, modular telephone plug 72 comprises an insulated housing 78 having a cable-receiving opening 80 therein which receives an end of insulated cable 70. Cable-receiving opening 80 communicates with first through sixth recesses (only fifth recess 82*e* is shown), corresponding to positions 1 through 6 of modular telephone plug 72 and positions 1 through 6 of modular jack 42, by means of first through sixth channels (only fifth channel 83*e* is shown).

Outside wires 74*a* and 74*d* of insulated cable 70 are connected by first and second insulation piercing tangs (only second tang 86 is shown) to first and second conductive blade-like terminals (only second terminal 90 is shown) contained in the second and fifth recesses, respectively. When modular telephone plug 72 is inserted into the plug-receiving opening 47 of modular jack 42, the tops of the first and second terminals engage the surfaces of spring contact portions 56 of conductors 52 and 54, respectively, in second and fifth recesses 48*b* and 48*e* in modular jack 42.

Referring now to FIG. 6, there is shown a modular monitor adapter 130 for use in connecting a VCR to a computer monitor.

Adapter 130 is the same as adapter 30, except that it utilizes an AF coaxial connector 44' of the phono plug type adapted to mate with the input terminal 4' of a computer monitor. A modular adapter 130 is generally used in conjunction with a modular adapter 30 coupled to the VCR and a connector cable 69 connecting adapters 30 and 130. In this way, the VCR output can be transmitted to a computer monitor.

Referring now to FIG. 7, there is shown a modular UHF adapter 230 for use in connecting the UHF output terminals of a VCR to the UHF input terminals 2*a* and 2*b* of a television. UHF adapter 230 is the same as modular VHF adapter 30, except that it utilizes a 300 ohm twin-lead cable 98 adapted to mate with 300 ohm UHF terminals. Twin-lead cable 98 is of a standard, commercially available variety, and comprises a pair of parallel, spaced-apart insulated conductive wires 100 and 102 terminated at one end by spade lugs 106 and 108, respectively. Wires 100 and 102 at their other end are electrically connected, for example by soldering, to the end portions 60 of conductors 52 and 54 of modular jack 42.

It should be noted that several variations of adapters 30, 130 and 230 are possible. Referring now to FIG. 8, there is shown an adapter 300 similar to adapter 30, but having an additional output. Adapter 300 comprises a moulded insulated housing 320 having first and second modular jack portions 34 and 34' having opposed first and second six-position modular jacks 42 and 42' therein and a coaxial connector portion 38, having an RF-connector 44 therein. Modular jack 42' is identical to modular jack 42, and is electrically connected to central conductor 62a and conductive wire sheath 62b of connector 64 in the same manner as modular jack 42.

Referring now to FIGS. 9 and 10, there is shown an adapter 300' similar to adapter 300, but having a double pole double throw slide switch 110 mounted therein to enable selection between first and second modular jacks 42 and 42'. Switch 110 is of standard configuration and is movable between first and second positions I and II. As shown in FIG. 10, it includes first and second pairs of end terminals 112 and 114 corresponding to first and second positions I and II, respectively, of switch 110, and a third center pair of terminals 116. First and second pairs of end terminals 112 and 114 are electrically connected, e.g. by soldering, to conductors 52 and 54 of modular jack 42 and to conductors 52' and 54' of modular jack 42', respectively. The third pair of terminals 116 is connected to central conductor 62a and conductive wire sheath 62b. Thus, when switch 110 is in first position I, coaxial connector 44 is connected to modular jack 42, and when switch 110 is in second position II, coaxial connector 44 is connected to modular jack 42'.

A modular adapter 300 or 300' is used to transmit the VCR output to two different devices, e.g. to two televisions, to a television and a computer monitor, etc. The RF-connector 44 of adapter 300 or 300' is coupled directed to the 75 ohm VHF output terminal 18b of the VCR. The appropriate modular adapter 30 or 130' is coupled to the 75 ohm VHF antenna terminal 4 of a television or the input terminal of a computer monitor, respectively. The adapter 300 or 300' is then electrically connected to each of the modular adapters 30 or 130 by a connector cable 70.

If it is desired to receive the output of a VCR in a first room on a television or a monitor in a second, third, or other room, the modular adapters of the invention can be used with modular connector cables 69 to transmit the VCR output through the building telephone system. This is accomplished by connecting an adapter 30, 300, or 300' to the VHF output 18b of the VCR, connecting one end of a first connector cable 69 to adaptor 30, 130', 300, or 300' and plugging the other end of first connector cable 69 into the room modular telephone jack. In the other room, an adapter 30 or 130 is plugged into the appropriate terminal of the receiving television or monitor, and the adaptor 30 or 130 is connected to the second or other room modular telephone jack using a second connector cable 69. There will be no interference with the building telephone system because most building (including home) telephone systems use only positions 3 and 4 of the modular plug and jack to transmit signals, while all the adapters 30, 130, 230, 300, and 300' of the invention and modular plug 72 use positions 2 and 5. The use of the present invention to transmit VCR output to video devices located in different rooms thus is limited only by the location of the building telephone system modular telephone jacks.

When the building telephone system is used to transmit the VCR output, it may be necessary to use a video amplifier to amplify a signal before transmission to the receiving television or monitor. Generally, this is the case when the VCR receives its input signal from an antenna. When a video amplifier is necessary, the video amplifier (not shown) is interposed between the VHF output terminal 18b of the VCR and the home telephone system modular telephone jack, using the appropriate adapter 30 or 230 and connector cables 70. If the video amplifier has multiple output terminals, it can also be used simultaneously to connect the VCR to a television or a computer monitor in the same room as the VCR.

Figure 11:
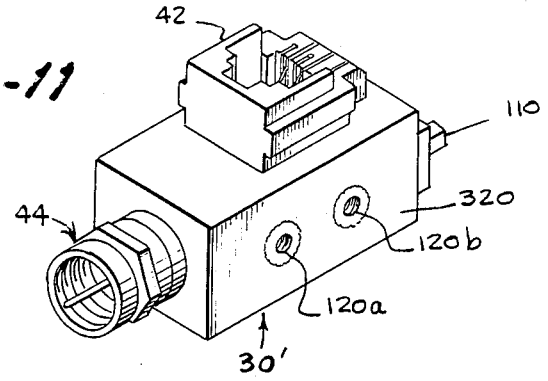
FIG. 11 is a perspective view of a VHF/UHF adapter according to the invention.
Figure 12:
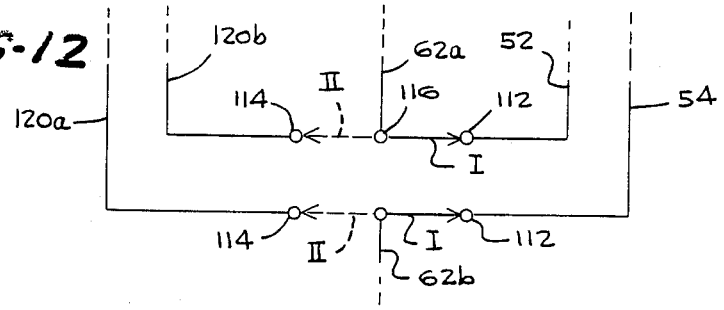
FIG. 12 is a partial circuit diagram of the VHF/UHF adapter of FIG. 11.

Other embodiments of a modular adapter according to the invention are possible for use in combination with the adapters shown in FIGS. 3–10. Referring now to FIGS. 11 and 12, there is shown an adapter 30' similar to adapter 30, but having in addition to a modular jack 42 and an RF-connector 44, a double pole, double throw slide switch 110 and a pair of 300 ohm screw terminals 120a and 120b positioned in housing 320. As shown in FIG. 12, first and second pairs of end terminals 112 and 114 of switch 110 are electrically connected, e.g. by soldering, to conductors 52 and 54 and to screw terminals 120a and 120b, respectively. The third pair of terminals 116 is connected to central conductor 62a and conductive wire sheath 62b of coaxial connector 44. Thus, when switch 110 is in first position I, coaxial connector 44 is connected to modular jack 42, and when switch 110 is in second position II, coaxial connector 44 is connected to screw terminals 120a and 120b.

A modular adapter 30' can be used to switchably connect a television either to a 300 ohm TV antenna (through 300 ohm screw terminals 120a and 120b) or to other video equipment (through modular jack 42), for example through the building telephone system as described above.

Figure 13:
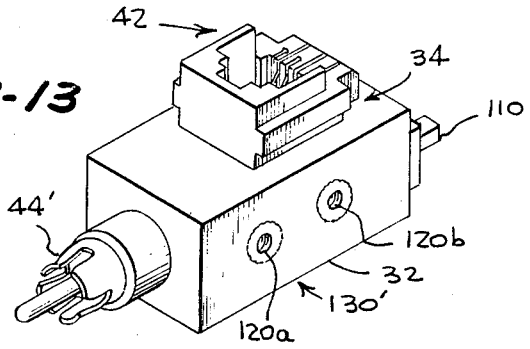
FIG. 13 is a perspective view of a second embodiment of a VHF/UHF adapter.
Figure 14:
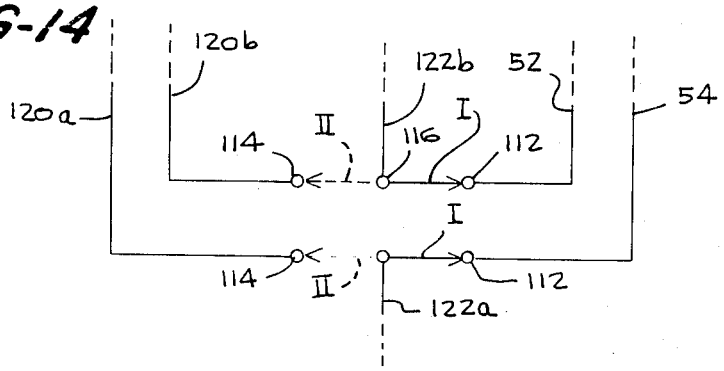
FIG. 14 is a partial circuit diagram of the VHF/UHF adapter of FIG. 13.

Referring now to FIGS. 13 and 14, there is shown an adapter 130' similar to adapter 130, but having an additional pair of screw terminals 120a and 120b and a switch 110 positioned in housing 32. Switch 110 is electrically connected to modular jack 42 and 300 ohm screw terminals 120a and 120b at first and second pair of end terminals 112 and 114 and to AF-connector 44' at the center pair of end terminals 116 in a similar manner as is accomplished with respect to adapter 30' shown in FIG. 11. As shown in FIG. 14, first and second pairs of end terminals 112 and 114 are electrically connected conductors 52 and 54 of modular jack 42 and to 300 ohm screw terminals 120a and 120b, respectively. The third pair of terminals 116 is connected to central conductor 62a' and conductive wire sheath 62b' of AF-connector 44'. Thus, when switch 110 is in first position I, coaxial connector 44' is connected to modular jack 42, and when switch 110 is in second position II, coaxial connector 44' is connected to 300 ohm screw terminals 120a and 120b.

A modular adapter 130' can be used to switchably connect a computer monitor directly to an antenna (through 300 ohm screw terminals 120a and 120b) or to the output from a VCR either directly or through the building telephone system (through modular jack 42).

Figure 15:
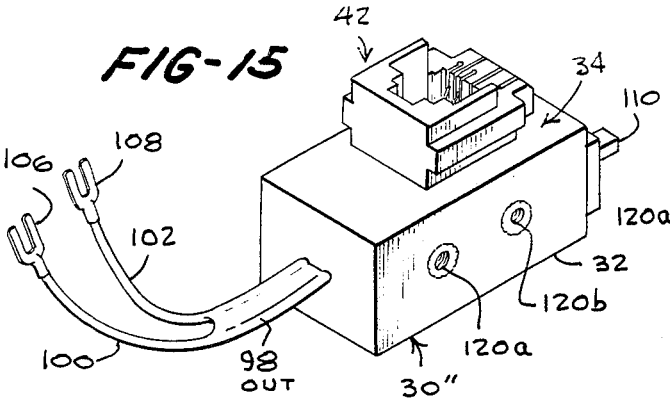
FIG. 15 is a perspective view of a second embodiment of a UHF adapter.
Figure 16:
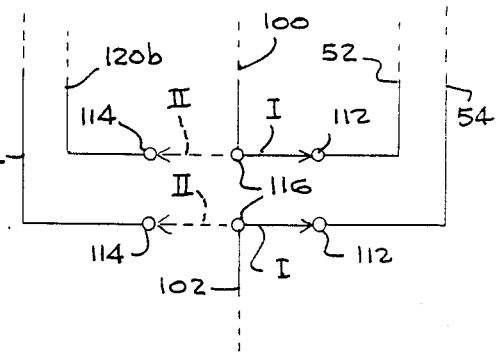
FIG. 16 is a partial circuit diagram of the UHF adapter of FIG. 15.

Referring now to FIGS. 15 and 16, there is shown an adapter 230' similar to adapter 230, but having an additional pair of screw terminals 120a and 120b and a switch 110 positioned in housing 32. Switch 110 enables selection between modular jack 42 and 300 ohm screw terminals 120a and 120b. As shown in FIG. 16, first and second pairs of end terminals 112 and 114 of switch 110 are electrically connected to conductors 52 and 54 of modular jack 42 and to 300 ohm screw terminals 120a and 120b, respectively.

The third pair of center terminals 116 is connected to conductive wires 100 and 102 of twin-lead cable 98.

Thus, when switch 110 is in first position I, twin-lead cable 98 is connected to modular jack 42, and when switch 110 is in second position II, twin lead cable 98 is connected to 300 ohm screw terminals 120*a* and 120*b*.

A modular adapter 230' can be used to switchably connect a television to a TV antenna directly (through 300 ohm screw terminals 120*a* and 120*b*) or to other video equipment indirectly (through modular jack 42), for example, through the home telephone system.

Figure 17:
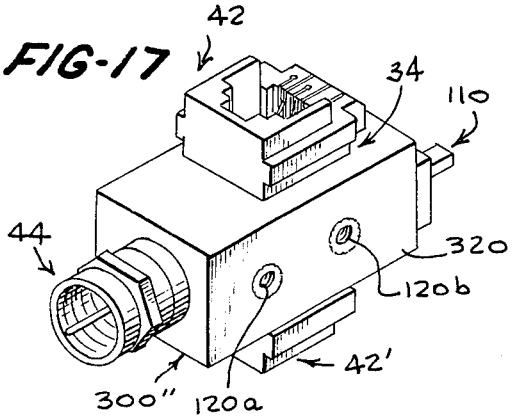
FIG. 17 is a perspective view of a third embodiment of a VHF/UHF adapter.
Figure 18:
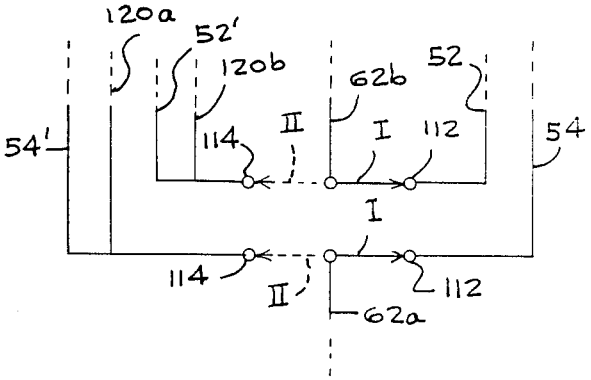
FIG. 18 is a partial circuit diagram of the VHF/UHF adapter of FIG. 17.

Referring now to FIGS. 17 and 18, there is shown an adapter 300'', similar to adapter 300', but having a pair of 300 ohm screw terminals 120*a* and 120*b* and a switch 110 positioned in housing 320. Switch 110 enables selection between modular jacks 42 and 42' and 300 ohm screw terminals 120*a* and 120*b*. As shown in FIG. 18, first pair of end terminals 112 of switch 110 is electrically connected to conductors 52 and 54 of modular jack 42, and second pair of end terminals 114 is electrically connected to conductors 52' and 54' of modular jack 42' and 300 ohm screw terminals 120*a* and 120*b*. The third pair of center terminals 116 is connected to central conductor 62*a* and conductive wire sheath 62*b* of coaxial connector 44. Thus, when switch 110 is in first position I, coaxial connector 44 is connected to modular jack 42, and when switch 110 is in second position II, coaxial connector 44 is connected to modular jack 42' and screw terminals 120*a* and 120*b*.

A modular adapter 300'' can be used to switchably connect a television either directly to an antenna (through screw terminals 120*a* and 120*b*) or indirectly to an antenna (through modular jack 42') or to a VCR (through modular jack 42).

Figure 19:
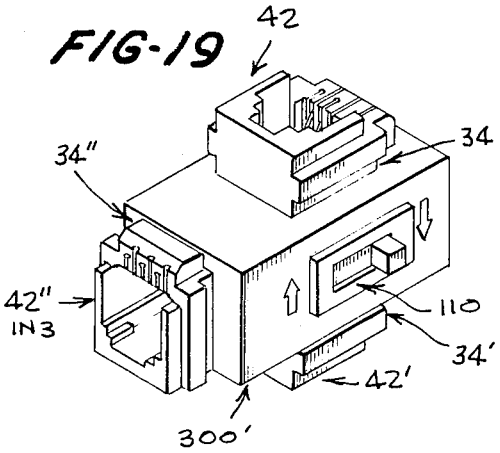
FIG. 19 is a perspective view of a switching adapter according to the invention.
Figure 20:
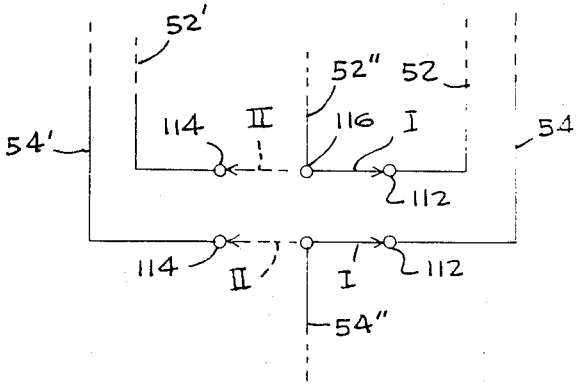
FIG. 20 is a partial circuit diagram of the switching adapter of FIG. 18.

Referring now to FIGS. 19 and 20, there is shown a modular adapter 400. Adapter 400 comprises a molded insulated housing 320 having first, second, and third modular jack portions 34, 34', and 34'' having first, second, and third six-position modular jacks 42, 42', and 42'' therein, and also a switch 110 mounted therein to enable selection between first and second modular jacks 42 and 42'. As shown in FIG. 20, first and second pairs of end terminals 112 and 114 are electrically connected to conductors 52 and 54 of modular jack 42 and to conductors 52' and 54' of modular jack 42', respectively. The third pair of center terminals 116 is connected to conductors 52'' and 54'' of modular jack 42''. Thus, when switch 110 is in first position I, modular jack 42'' is connected to modular jack 42, and when switch 110 is in second position II, modular jack 42'' is connected to modular jack 42''.

A modular adapter 400 can be used to switchably connect either of two articles of video equipment (through modular jacks 42 and 42'), for example, a VCR and a TV antenna, to a third article of video equipment (through modular jack 42''), for example, through the building telephone system.

Thus, it will be seen that all embodiments of the present invention provide unique apparatus for connecting a VCR to other video equipment, and for transmitting video signals between different articles of video equipment through the building telephone system. Moreover, the installation and operation of the apparatus is both effective and easy to accomplish, so as to render use of all embodiments convenient to users. While preferred embodiments of the invention have been disclosed, it should be understood that the spirit and scope of the invention are to be limited solely by the appended claims, since numerous modifications of the disclosed embodiments will undoubtedly occur to those of skill in the art.

I claim:

1. A modular adapter for connection to a 75 ohm VHF terminal of an article of video equipment, comprising:

an insulated housing comprising a modular jack portion having a modular jack-receiving opening extending therein and a coaxial connector portion having a coaxial connector-receiving opening extending therein;

a standard, six-position modular telephone jack positioned in said modular jack-receiving opening, said jack having first and second conductors mounted therein in two of said six positions; and a male coaxial connector positioned in said coaxial connector-receiving opening and including a solid central conductor and a conductive wire sheath insulated from said solid central conductor, said solid central conductor being electrically connected to said first conductor of said modular jack and said conductive wire sheath being electrically connected to said second conductor of said modular jack.

2. The adapter of claim 1, said coaxial connector being an RF coaxial connector.

3. The apparatus of claim 1, said coaxial connector being an AF coaxial connector.

4. The adapter of claim 1, said first and second conductors being positioned in positions two and five of said modular jack.

5. Apparatus for connecting the UHF output terminals of a video cassette recorder to the UHF input terminals of a television, comprising:

first and second modular adapters, each said modular adapter comprising:

an insulatimg housing comprising a modular jack portion having a modular jack-receiving opening extending therein and a cable portion having a cable-receiving opening extending therein; a standard, six-position modular telephone jack positioned in said modular jack-receiving opening, said jack having first and second conductors mounted therein in two of said six positions; and 300 ohm twin-lead cable means positioned in said cable-receiving opening and comprising first and second parallel, spaced-apart insulated conductive wires having first and second ends, said first ends of said first and second wires being terminated by means for connecting said first ends of said wires to a pair of 300 ohm video terminals, said second end of said first wire being electrically connected to said first conductor of said modular jack, and said second end of said second wire being electrically connected to said second conductor of said modular jack; and a connector cable comprising an insulated cable having first and second ends terminated respectively by first and second standard, six-positioned modular telephone connectors insertable into said first and second modular jacks, said insulated cable having at least first and second insulated conductive wires therein and each of said modular connectors having only first and second conductive terminals contained therein piercing said first and second wires respectively, said first and second conductive terminals being positioned in two of said six positions of said modular connectors corresponding to the positions in which said first and second conductors are mounted in said modular jacks.

6. The apparatus of claim 5, said conductors of each said modular jack being positioned in positions two and five of said modular jack.

7. A modular adapter for connection to the 75 ohm VHF output terminal of a video cassette recorder, comprising:

an insulated housing comprising first and second modular jack portions having first and second modular jack-receiving openings, respectively, extending therein and a coaxial connector portion having a coaxial connector-receiving opening extending therein;

first and second standard, six-position modular telephone jacks positioned respectively in said first and second modular jack-receiving openings, each of said modular jacks having first and second conductors mounted therein in two of said six positions; and a male coaxial connector positioned in said coaxial connector-receiving opening and including a solid central conductor and a conductive wire sheath insulated from said solid central conductor, said solid central conductor being electrically connected to said first conductors of both of said modular jacks and said conductive wire sheath electrically connected to said second conductors of both of said modular jacks.

8. The adapter of claim 7, said first and second conductors being positioned in positions two and five of both of said modular jacks.

9. A modular adapter for connection to a 75 ohm VHF terminal of an article of video equipment, comprising:

an insulated housing comprising a modular jack portion having a modular jack-receiving opening extending therein, a coaxial connector portion having a coaxial connector-receiving opening extending therein, a screw terminal portion having first and second spaced-apart screw terminal-receiving openings extending therein, and a switch portion having a switch-receiving opening extending therein;

a standard, six-position modular telephone jack positioned in said modular jack-receiving opening, said jack having first and second conductors mounted therein in two of said six positions;

a male coaxial connector positioned in said coaxial connector-receiving opening and including a solid central conductor and a conductive wire sheath insulated from said solid central conductor;

first and second 300 ohm screw terminals positioned in said first and second screw terminal-receiving openings, respectively; and switch means movable between a first and second position for selectively connecting said coaxial connector to one of said modular jack and said first and second 300 ohm screw terminals, respectively, said switch means having first, second, and third conductive means, said first conductive means being electrically connected to said first and second conductors of said modular jack said second conductor means being electrically connected to said first and second 300 ohm screw terminals, and said third conductor means being electrically connected to said solid central conductor and said conductive wire sheath of said coaxial connector.

10. The adapter of claim 9, said coaxial connector being an RF coaxial connector.

11. The apparatus of claim 9, said coaxial connector being an AF coaxial connector.

12. The adapter of claim 9, said first and second conductors being positioned in positions two and five of said modular jack.

13. A modular adapter for connection to a 300 ohm UHF terminal of a piece of video equipment, comprising:

an insulated housing comprising a modular jack portion having a modular jack-receiving opening extending therein, a cable portion having a cable-receiving opening extending therein, a screw terminal portion having first and second spaced-apart screw terminal-receiving openings therein, and a switch portion having a switch-receiving opening extending therein;

a standard, six-position modular telephone jack positioned in said modular jack-receiving opening, said jack having first and second conductors mounted therein in two of said six positions;

300 ohm twin-leaded cable means positioned in said cable-receiving opening and comprising first and second parallel, spaced-apart, insulated conductive wires having first and second ends, said wires being terminated at said first ends by means for connecting said first ends of said wires to a pair of 300 ohm video terminals;

first and second 300 ohm screw terminals positioned in said first screw terminal-receiving openings, respectively; and switch means movable between a first and second position for selectively connecting said coaxial connector to one of said modular jack and said first and second 300 ohm screw terminals, respectively, said switch means having first, second, and third conductive means, said first conductive means being electrically connected to said first and second conductors of said modular jack, said second conductor means being electrically connected to said first and second 300 ohm screw-terminals, and said third conductor means being electrically connected to said second ends of said first and second wires of said cable means.

14. The adapter of claim 13, said first and second conductors being positioned in positions two and five of said modular jack.

15. A modular adapter for connection to the 75 ohm VHF output terminal of a video cassette recorder, comprising:

an insulated housing comprising first and second modular jack portion having first and second modular jack-receiving opening, respectively, extending therein and a coaxial connector portion having a coaxial connector-receiving opening extending therein, a screw terminal portion having first and second spaced-apart screw terminal-receiving openings extending therein, and a switch portion having a switch-receiving opening extending therein;

first and second standard, six-position modular telephone jacks positioned respectively in said first and second modular jack-receiving openings, each of said modular jacks having first and second conductors mounted therein in two of said six positions;

a male coaxial connector positioned in said coaxial connector-receiving opening and including a solid central conductor and a conductive wire sheath insulated form said solid central conductors;

first and second 300 ohm screw terminals positioned in said first and second screw terminal-receiving openings respectively, and switch means movable between first and second positions for selectively connecting said coaxial connector to said first modular jack and to said second modular jack and said first and second 300 ohm screw terminals, respectively, said switch means having first, second, and third conductive means, said first conductive means being electrically connected to said first and second conductors of said first modular jack, said second conductor means being electrically connected to said first and second conductors of said second modular jack and said first and second 300 ohm screw terminals, and said third connector means being electrically connected to said solid central conductor and said conductive wire sheath of said coaxial connector.

16. The adapter of claim 15, said first and second conductors being positioned in positions two and five of each said modular jack.

17. A modular adapter for connection to the 75 ohm VHF output terminal of a video cassette recorder, comprising:

an insulated housing comprising first, second, and third modular jack portions having first, second, and third modular jack-receiving openings, respectively, extending therein, and a switch portion having a switch-receiving opening extending therein;

first, second, and third standard, six-position modular telephone jacks positioned respectively in said first, second, and third modular jack-receiving openings, each of said modular jacks having first and second conductors mounted therein in two of said six positions; and switch means movable between a first and second position for selective connecting said third modular jack to one of said first and second modular jacks, respectively, said switch means having first, second, and third conductive means, said first conductive means being electrically connected to said first and second conductors of said first modular jack, said second conductor means being electrically connected to said first and second conductors of said second modular jack, and said third conductor means being electrically connected to said first and second conductors of said third modular jack.

18. The adapter of claim 17, said first and second conductors being positioned in positions two and five of each said modular jack.

* * * * *